US009614327B2

(12) United States Patent
Marsh et al.

(10) Patent No.: US 9,614,327 B2
(45) Date of Patent: Apr. 4, 2017

(54) ELECTRICAL CONNECTOR AND ASSEMBLY THEREWITH HAVING A SPRING-APART FUNCTION

(71) Applicants: Tyco Electronics UK Ltd, Wiltshire (GB); TE Connectivity India Private Limited, Bangalore (IN)

(72) Inventors: John Marsh, London (GB); Gopi Kt, Karnataka (IN)

(73) Assignees: TE Connectivity India Private Limited, Bangalore (IN); Tyco Electronics UK Ltd, Wiltshire (GB)

( * ) Notice: Subject to any disclaimer, the term of this patent is extended or adjusted under 35 U.S.C. 154(b) by 0 days.

(21) Appl. No.: 14/732,334

(22) Filed: Jun. 5, 2015

(65) Prior Publication Data

US 2015/0270644 A1 Sep. 24, 2015

Related U.S. Application Data

(63) Continuation of application No. PCT/IN2013/000755, filed on Dec. 6, 2013.

(30) Foreign Application Priority Data

Dec. 7, 2012 (IN) ..... 5118/CHE/2012

(51) Int. Cl.
*H01R 13/627* (2006.01)
*H01R 13/639* (2006.01)

(52) U.S. Cl.
CPC ..... *H01R 13/639* (2013.01); *H01R 13/6273* (2013.01); *H01R 2201/26* (2013.01)

(58) Field of Classification Search
CPC ..... H01R 13/6272; H01R 13/6275; H01R 13/641; H01R 13/7032
(Continued)

(56) References Cited

U.S. PATENT DOCUMENTS 2,013,164 A 9/1935 Meyer
6,149,448 A * 11/2000 Haller ..... H01R 13/641 439/188
(Continued)

FOREIGN PATENT DOCUMENTS

CN 101682140 A 3/2010
EP 2685570 A1 1/2014
JP 11144804 A 5/1999

OTHER PUBLICATIONS

International Search Report, Application No. PCT/IN2013/000755, 3 pages.
(Continued)

*Primary Examiner* — Hien Vu
(74) *Attorney, Agent, or Firm* — Barley Snyder

(57) ABSTRACT

A connector assembly is provided and includes a connector, a lock, and a spring arrangement. The connector has a housing, a spring arrangement holder, and a plug section. The housing has an upper shell and a lower shell that provide a lock receiving passageway into an interior thereof. The spring arrangement holder is disposed along the lower shell. The plug section is disposed along the lower shell and opposite the spring arrangement holder. The lock is inserted into the lock receiving passageway. The spring arrangement is inserted into the spring arrangement holder.

17 Claims, 7 Drawing Sheets

(58) Field of Classification Search
USPC ..... 439/352, 188, 620.07
See application file for complete search history.

(56) References Cited

U.S. PATENT DOCUMENTS

| | | | | |
|---|---|---|---|---|
| 6,435,894 | B2 * | 8/2002 | Little | H01R 13/7032 439/188 |
| 6,743,051 | B2 | 6/2004 | Hayashi | |
| 7,108,539 | B2 * | 9/2006 | Gunreben | H01R 13/639 439/352 |
| 7,833,044 | B2 * | 11/2010 | Bouchan | H01R 13/6273 439/352 |
| 8,801,456 | B2 * | 8/2014 | Miyakawa | H01R 13/111 439/466 |
| 8,968,021 | B1 * | 3/2015 | Kennedy | H01R 13/6273 439/352 |
| 2003/0040211 | A1 | 2/2003 | Saka et al. | |
| 2004/0192098 | A1 | 9/2004 | Pavlovic et al. | |
| 2008/0153343 | A1 | 6/2008 | Kobayashi et al. | |
| 2013/0164996 | A1 | 6/2013 | Miyakawa et al. | |

OTHER PUBLICATIONS

Chinese Office Action and English translation, dated Jul. 22, 2016, 20 pages.
Abstract of CN101682140, dated Mar. 24, 2010, 2 pages.
Abstract ofJPH11144804, dated May 28, 1999, 2 pages.
European Office Action, dated Nov. 17, 2016, 9 pages.

* cited by examiner

Section W W

ELECTRICAL CONNECTOR AND ASSEMBLY THEREWITH HAVING A SPRING-APART FUNCTION

CROSS-REFERENCE TO RELATED APPLICATIONS

This application is a continuation of PCT International Application No. PCT/IN2013/000755 filed Dec. 6, 2013, which claims priority under 35 U.S.C. §119 to IN Application No.: 5118/CHE/2017, filed Dec. 7, 2012.

FIELD OF THE INVENTION

The present invention relates to a connector and, in particular, an electrical connector for a squib in an airbag arrangement in a vehicle.

BACKGROUND

Electrical connectors and electrical plug-in connector assemblies generally include a connector as well as a mating connector. The connector assemblies are used e.g. for establishing an electrical connection to an airbag arrangement in a vehicle in order to activate the squib and hence inflate the airbag in case of an emergency or accident. According to the prior art, there is a risk that a connector is not fully mated with a mating connector, e.g. because they are not properly latched in a fully mated position. Hence, the connector and the mating connector can accidentally unmate and thereby lead to failure.

European Patent Application No. 12176217.3 filed by the applicant on Jul. 12, 2012 generally discloses a known plug-in connector assembly.

SUMMARY

In view of the disadvantages of plug-in connector assemblies according to the prior art mentioned above, an object underlying the invention is to provide a connector assembly having a connector, a lock, and a spring arrangement.

The connector has a housing, a spring arrangement holder, and a plug section. The housing has an upper shell and a lower shell that provide a lock receiving passageway into an interior thereof. The spring arrangement holder is disposed along the lower shell. The plug section is disposed along the lower shell and opposite the spring arrangement holder. The lock is inserted into the lock receiving passageway. The spring arrangement is inserted into the spring arrangement holder.

BRIEF DESCRIPTION OF THE DRAWINGS

The invention will now be described by way of example with reference to the accompanying figures of which.

DETAILED DESCRIPTION OF THE EMBODIMENT(S)

Figure 1:
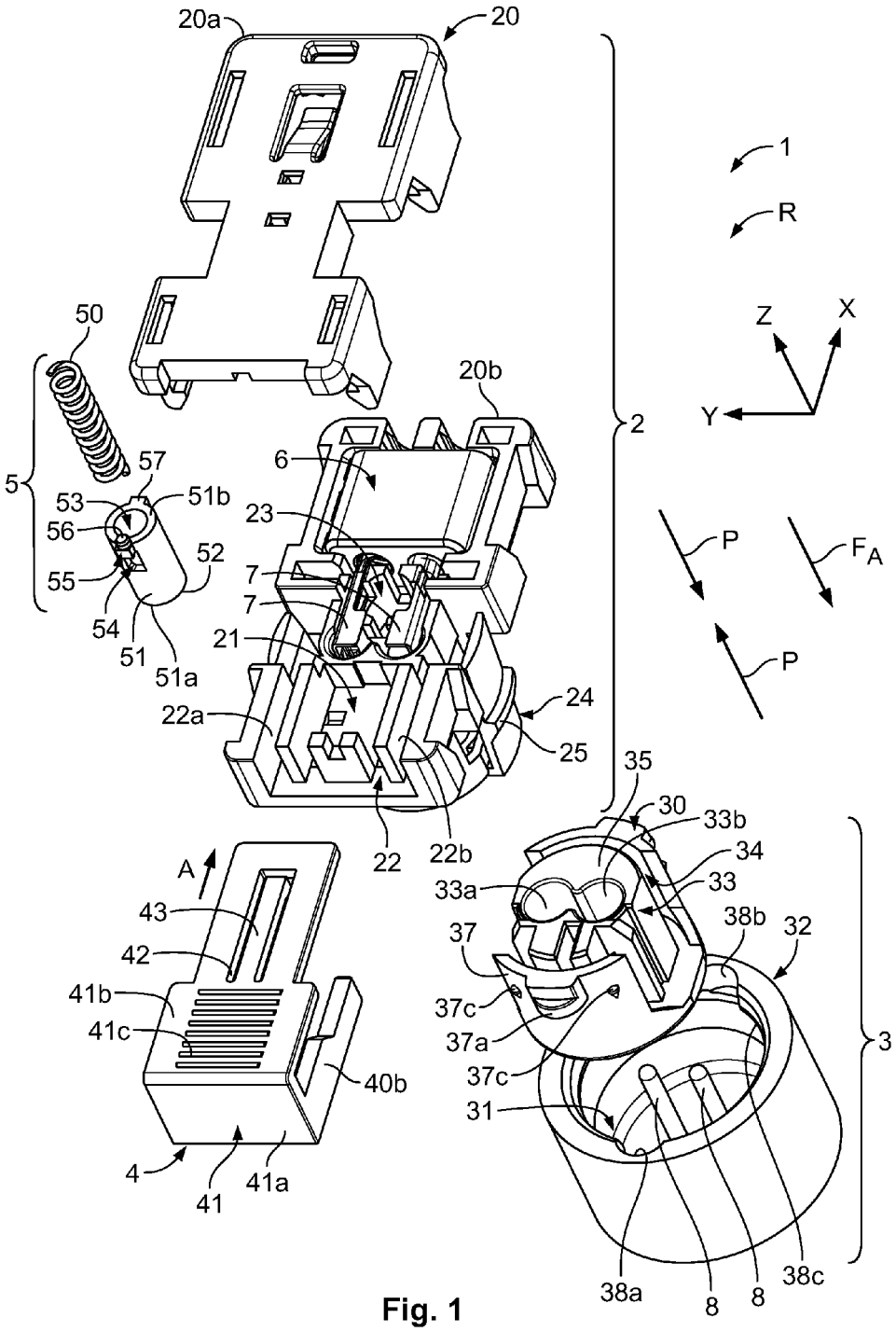
FIG. 1 is an exploded perspective view of a plug-in connector assembly according to the invention.

The invention will be described in more detail by way of example hereinafter using advantageous embodiments and with reference the accompanying drawings. The described embodiments are only possible configurations in which the individual features can, however, as described above, be implemented independently of each other or can be omitted. Similar elements shown in the drawings are provided with similar reference signs. Redundant parts of the description relating to similar elements shown in different drawings are left out.

An exemplary construction of a plug-in connector assembly 1 according to an embodiment of the present invention will be first described in the following with reference to FIG. 1, which shows an exploded view of the plug-in connector assembly 1.

The plug-in connector assembly 1 includes a connector 2, a mating connector 3, a lock 4 and a spring arrangement 5. The lock 4 and the spring arrangement can but do not have to necessarily be regarded as parts of and/or related to the connector 2. The plug-in connector assembly 1 can be used for electrically connecting and/or accommodating an electrical component 6, (e.g. a filter) of an airbag arrangement in a vehicle. The electrical component 6 can be received within the connector 2.

The connector 2 has a housing 20 having an upper shell 20*a* and a lower shell 20*b* providing an interior 21 of the connector when transferred from its pre-assembly state R shown in FIG. 1 to an assembled state S described further below. The interior 21 is adapted for accommodating electrical conductors, (i.e. contact elements) 7 which can be terminals and electrical lines, as well as other functional elements of the electrical component 6. In the present embodiment, the contact elements 7 are received in the lower shell 20*b*. A lock receiving passageway 22 to the interior 21 is formed as an opening laterally at the housing 20, (e.g., as a rear opening), and provides guides 22*a* and 22*b* defining an actuating direction A for the lock 4.

A holder 23 for the spring arrangement 5 is formed as a shaft or slot within the housing 20, in particular in the lower shell 20*b*. The holder 23 has an essentially cylindrical shape extending in a plug direction P into a plug section 24 of the connector 2. The plug section 24 is formed at the lower shell 20*b* and extends therefrom in the plug direction P in which the connector 2 is adapted to be mated to the mating connector 3. A latch 25 of the connector 2 can be formed as a part of the plug section 24 so that it protrudes laterally from the housing 20 in the plug direction P in order to latch the connector 2 and the mating connector 3 in a fully mated position M (not yet shown).

The mating connector 3 includes a retainer 30 received within a pocket 31 formed by a casing 32 of the mating connector 3. A mating plug section 33 of the mating connector 3 is formed at the retainer 30 and provides a cavity 34 for at least partially accommodating the plug section 24 of the connector 2. The retainer 30 is provided with orientation elements 37*a*, 37*b* to be fitted in the respective counter orientation elements 38*a*, 38*b* so that the retainer 40 can only be inserted into the pocket 31 with a pre-defined orientation. Securing elements 37*c* in the form of bosses on the outer circumference of the retainer 30 enable the retainer to be fixed within the pocket 31 in that the securing elements are brought into engagement with a counter securing element 38*c* formed as a groove extending along the inner circumference of the pocket 31. Mating contact elements 8 adapted to be mated with contact elements 7 extend in a mating plug direction P' which runs essentially opposite to the plug direction P. The mating contact elements 8 are designed to be coaxially arranged within mating contact receptacles 33*a* and 33*b* formed in the mating plug section 33.

The lock 4 includes two shafts 40*a* and 40*b*, which are adapted to be guided and supported by the guides 22*a*, 22*b* of the connector 2, respectively, so that they extend into the interior 21 of the housing 20 of the connector 2. The shafts 40*a*, 40*b* extend essentially in parallel to the actuating direction A. A disabling mechanism (not yet shown) is arranged between the shafts 40*a*, 40*b*, and is used for disabling the spring arrangement 5. The shafts 40*a*, 40*b* and the disabling mechanism protrude from an actuating section 41 or body section of the lock 4. The actuating section 41 provides a lateral face 41*a* facing opposite to the actuating direction A so that the lock 4 can be actuated by exerting a pressure onto the lateral face 41*a* in the actuating direction A. A cover section 41*b* extends laterally away from the lateral face 41*a* in the actuating direction A, so that the cover section 41*b* runs essentially in parallel to the shafts 40*a*, 40*b* and the disabling mechanism. A ribbing 41*c* is formed at a top of the cover section 41*b* in order to enhance a grip for actuating the lock 4 in the actuating direction A. In a slit 42 provided in the cover section 42*b*, a resiliently deflectable blocking mechanism 43 of the lock 4 is arranged at the lock 4, in particular at the cover section 42*b* so that the blocking mechanism 43 is at least partially embedded within and extending along a slit 42. The blocking mechanism 43 is adapted to interact with the housing 20 and the spring arrangement 5.

The spring arrangement 5 includes a spring 50, which can be embodied e.g. as a helical spring as shown in FIG. 1, and a plunger 51. The plunger 51 has an essentially tubular or cylindrical body which provides on its lower side 51*a* a spring-apart face adapted to exert a spring-apart force FA onto the mating connector 3, in particular onto a front face 35 formed at the retainer 30 and facing essentially opposite to the plug direction P, i.e. into the mating plug direction P'. Further, the plunger 51 provides a spring holder 53 formed as a bore or insertion for accommodating the spring 50. A slot 54 is formed in the wall of the plunger 51 and extends through the wall into the spring holder 53. Above the slot 54, a releasing mechanism 55 is arranged which protrudes laterally away from the plunger in a direction opposite to the plug direction P and perpendicular to the actuating direction A. The releasing mechanism is provided with a release element 56 which extends above the upper side 51*b* of the plunger 51 in a direction opposite to the plug direction P. On a side of the plunger 51 opposing the side where the slot 54 and the releasing mechanism 55 are arranged, the plunger 51 is provided with a limit stop 57 adapted for limiting movements of the plunger 51 within the holder 23 in the plug direction P.

As shown in FIG. 1, a longitudinal direction X, a transverse direction Y and a height direction Z can be assigned to the plug-in connector assembly 1. The longitudinal direction X, the transverse direction Y and the height direction Z each extend perpendicular with respect to each other such that they can be regarded as constituting a Cartesian coordinate system. All mentions of a front or rear side of parts of the plug-in connector assembly 1 can be associated with the longitudinal direction X. All mentions of a left or right side can be associated with the transverse direction Y. All mentions of upper or lower sides or above or below can be associated with the height direction Z. The actuating direction A can run essentially in parallel to the longitudinal direction X. The plug direction P, the mating plug direction P' and the spring-apart force FA can essentially extend in parallel to the height direction Z.

Figure 2:
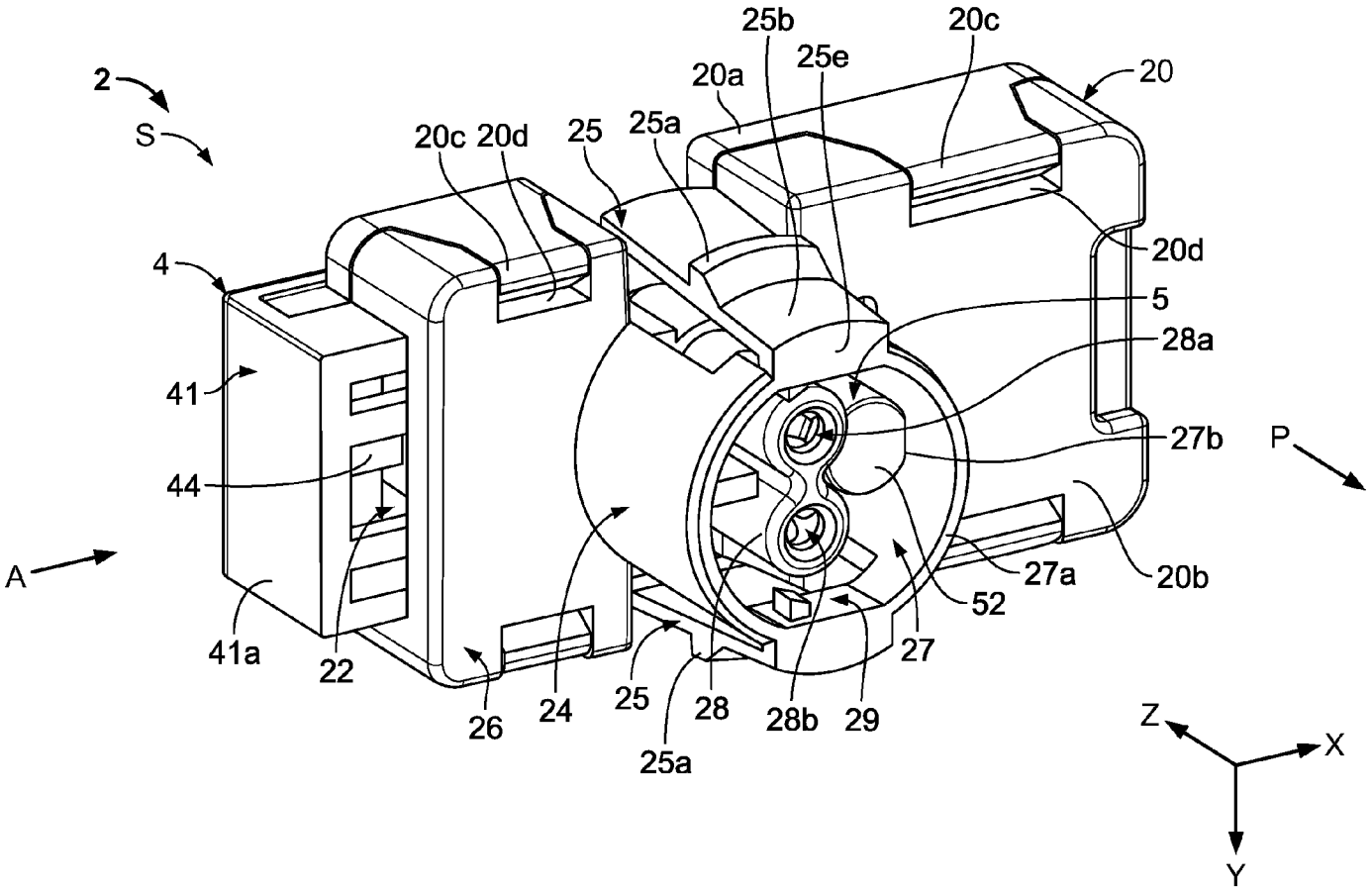
FIG. 2 is another perspective view of a connector according to the connector assembly according to the invention.

With reference to FIG. 2, the connector 2 is shown in an assembled state S, wherein the upper shell 20*a* and the lower shell 20*b* are assembled in order to form the housing 20, the lock 4 is inserted into the lock receiving passageway 22 and the spring arrangement 5 is inserted into the holder 23. In the schematic perspective view shown in FIG. 2, it becomes apparent that the upper shell 20*a* is provided with a securing element 20*c* in the form of a latching tongue interacting with a counter securing element 20*d* in the form of latching recess of the lower shell 20*b* so that the upper shell 20*a* is securely fixed to the lower shell 20*b*. The plug section 24 extends away from a base section 26 of the connector 2 in the plug direction P and opens in the plug direction P at a plug opening 27, which is surrounded by a wall section 27*a* of the connector 2. A terminal housing section 28 with receptacles 28*a* and 28*b* for the contact elements 7 is arranged within the plug opening 27 so that it protrudes from the base section 26 in the plug direction P and the receptacles 28*a*, 28*b* open in the plug direction P for receiving the mating contact elements 8.

The spring arrangement 5 is arranged next to the terminal housing section 28 so that the spring-apart face 52 faces in the plug direction P. A guide 27*b* formed as a recess or groove extending along the inner wall of the plug section 24 runs essentially in parallel to the plug direction P. The spring arrangement 5, in particular the plunger 51, is partly in engagement with the guide 27*b* so that the spring-part force 52 is essentially linearly guided along the plug direction P. The latches 25 are arranged laterally at the plug section 23 and are each provided with a detent 25*a* arranged at a latching tongue 25*b* each connected to the wall section 27*a* via transition regions 25*c*. The plug opening 27 with the terminal housing section 28, the spring arrangement 5 and the transition regions 25*c* form a plug face 29 of the connector 2. Further, in FIG. 2 it becomes apparent that the lock 4 is provided with a disabling mechanism 44 extending away from the actuation section 41 in the actuation direction A. The disabling mechanism 44 is formed as a beam designed to snugly fit into the slot 54 in the plunger 51 of the spring arrangement 5.

Figure 3:
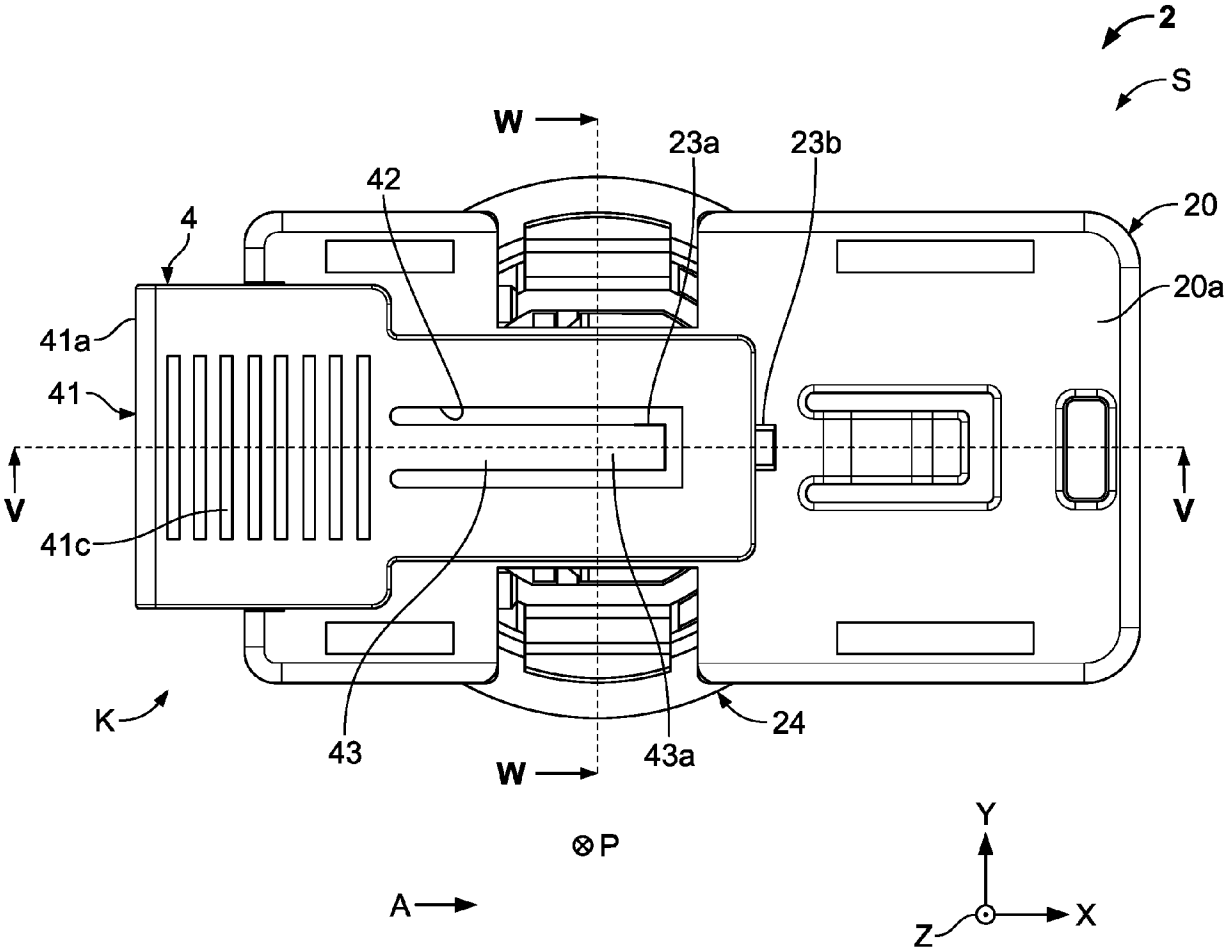
FIG. 3 is a top view of the connector shown in FIG. 2.

Now with reference to FIG. 3, the connector 2 in the assembled state S is shown. Here it becomes apparent that the lock 4 is in a pre-locking position K. In the pre-locking position K, the lock 4 is arrested at the connector 2 by means of a catch 43*a* formed at the end of the blocking mechanism 43 pointing into the actuation direction A. The catch 43*a* is in engagement with a first counter catch 23*a* formed at the housing 20, in particular in the top or sealing of the upper shell 20*a*. Further, a second counter catch 23*b* is formed in the housing 20 behind the first counter catch in the actuation direction A, in order to arrest the lock 4 in a locking position L (not yet shown).

Figure 4:
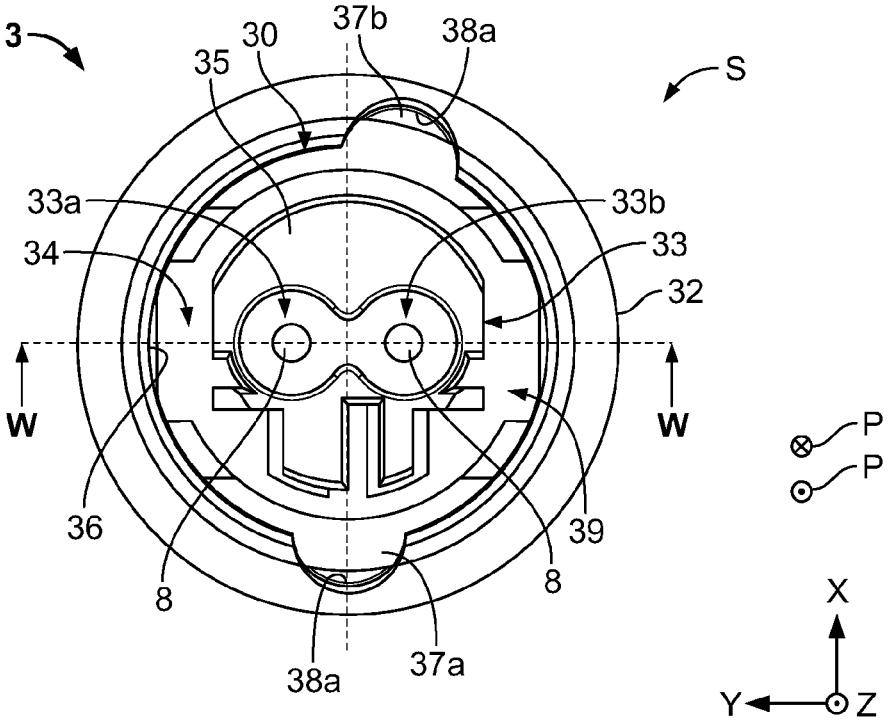
FIG. 4 is a top view of a mating connector of the connector assembly according to the invention.

Now with reference to FIG. 4, the mating connector 3 is shown in the assembled state S, where the retainer 30 is inserted into and latched within pocket 31. The cavity 34 for receiving the plug section 24 is formed between the mating plug section 33 and a mating wall section 36 of the casing 32, in particular the inner circumference of the pocket 31, as well as between the mating plug section 33 and the two fixation members 37, providing the orientation elements 37*a* and 37*b* engaging the counter orientation elements 38*a* and 38*b* formed in the pocket 31. The securing elements 37*c* in the form of bosses arranged at the outer circumference of the fixation members 37 jut into the counter securing element 38*c* formed as a circumferential groove extending along the inner circumference of the pocket 31. Together, the retainer 30 and the pocket 31 now define a mating plug face 39 of the mating connector facing in the mating plug direction P' and complementing the plug face 29 of the connector 2.

Figure 5:
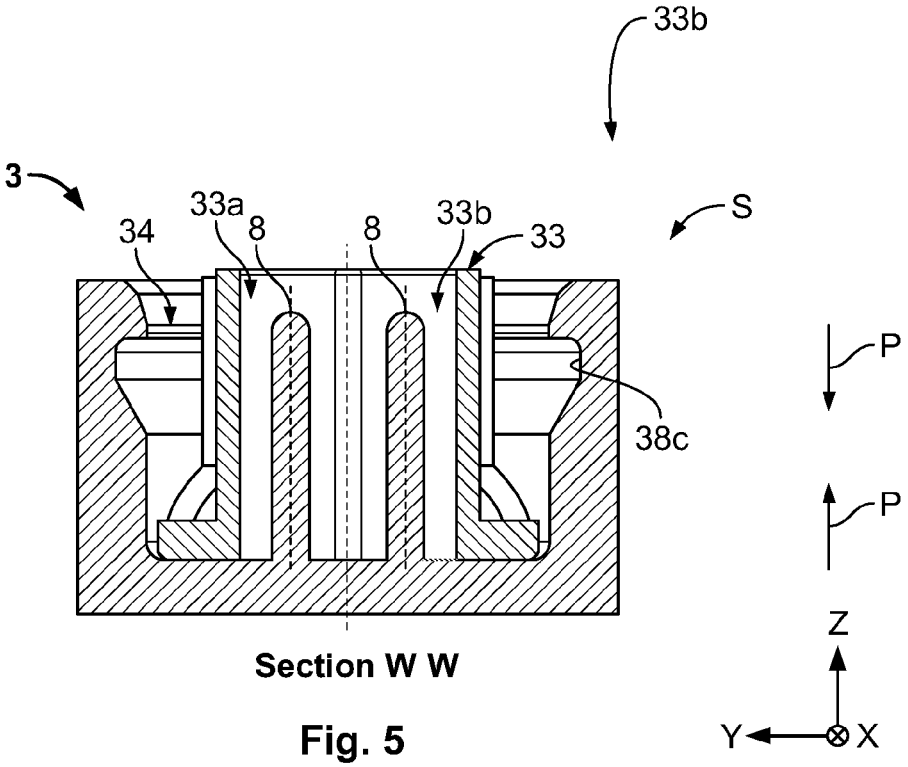
FIG. 5 is a cross-sectional view of the mating connector shown in FIG. 4 taken along line W-W.

With respect to FIG. 5, it becomes apparent that the mating contact elements 8 in the form of contact pins extend through the mating contact receptacles 33*a*, 33*b*, respectively, in the mating contact direction P'. The counter securing element 38*c* is formed so that it can receive the securing elements 37*c* as well as the detents 25*a* of the latches 25 of the plug section 24, which is to be inserted into the cavity 34.

Figure 6:
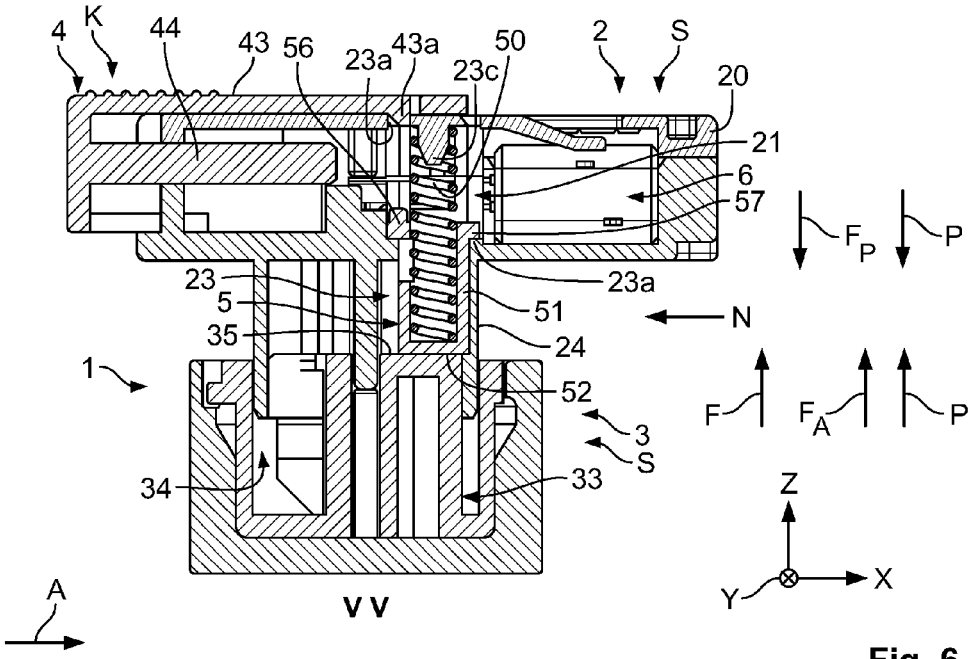
FIG. 6 is a cross-sectional view of the connector assembly shown in FIG. 1 taken along line V-V.

As shown in FIG. 6, the plug-in connector assembly 1 is shown in a spring-apart position N, in which the plug section 24 of the connector 2 is half-way inserted into the cavity 34. In the spring-apart position N, the contact elements 7 and the mating contact elements 8 are prevented from being electrical connected to each other. The plug-in connector is shown in the assembled state S, i.e. in a state where the connector 2 and the mating connector 3 are assembled. The spring-apart face 52 of the spring arrangement 5 abuts the front face 35 of the mating plug section 33, so that an engaging force FP has to be generated that overcomes the spring force FS of the spring 50, the spring force FS corresponding to a spring-apart force FA, wherein the engaging force FP is exerted in the plug direction P and the spring force F as well as the spring force FA are exerted onto the connector 2 opposite to the plug direction P, i.e. in the mating plug direction P'.

The spring 50 is centered within the plunger 51 and the interior 21 of the plug element 2 by the inner circumference of the spring holder 53 and a pin 23*c* formed at the top or ceiling of the housing 20 and protruding therefrom downwardly in the plug direction P towards the plunger 51. The plunger 51 is received within the holder 23 such that it can slide along the holder 23 in and against the plug direction P. Movements of the plunger 51 are limited in the plug direction P in that the limit stop 57 of the plunger 51 abuts an abutment 23*d* formed in the interior 21 of the housing 21 next to the holder 23. Further, the lock 4 is in the pre-locking position K, wherein the catch 43*a* on the blocking mechanism 43 extends into the first counter catch 23*a* so that a movement of the lock 4 is limited and/or inhibited in and/or opposite to the actuation direction A. Thereby, the lock 4 indicates that the plug-in connector assembly 1 has not properly reached the fully mated position M (not yet shown) and is at the same time held captive at the housing 20.

Figure 7:
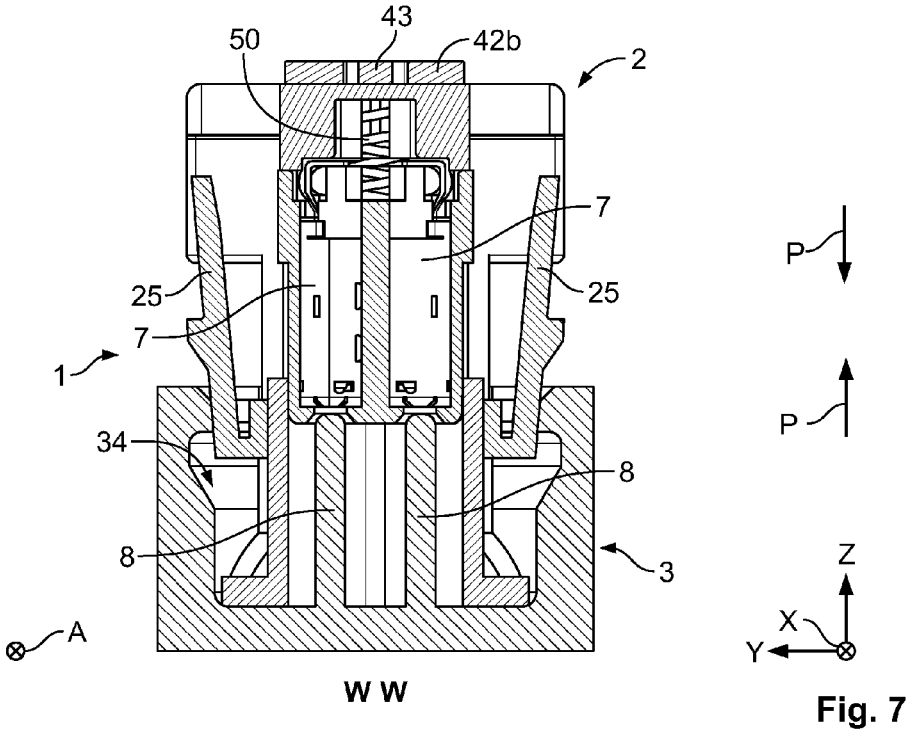
FIG. 7 is a cross-sectional view of the connector and mating connector shown in FIGS. 3 and 4 taken along line W-W.

FIG. 7, in analogy to FIG. 6, shows the plug-in connector assembly 1 in the assembled state S in the spring-apart position N in a schematic cross-sectional view along the cross-sectional line W-W shown in FIGS. 3 and 4. The latches 25 are halfway inserted into the cavity 34. The contact elements 7 are situated above the mating contact elements 8 and are aligned with the mating contact elements 8 in the plug direction P in order to be mated therewith when pushing the connector 2 downwardly into the mating connector 3.

Figure 8:
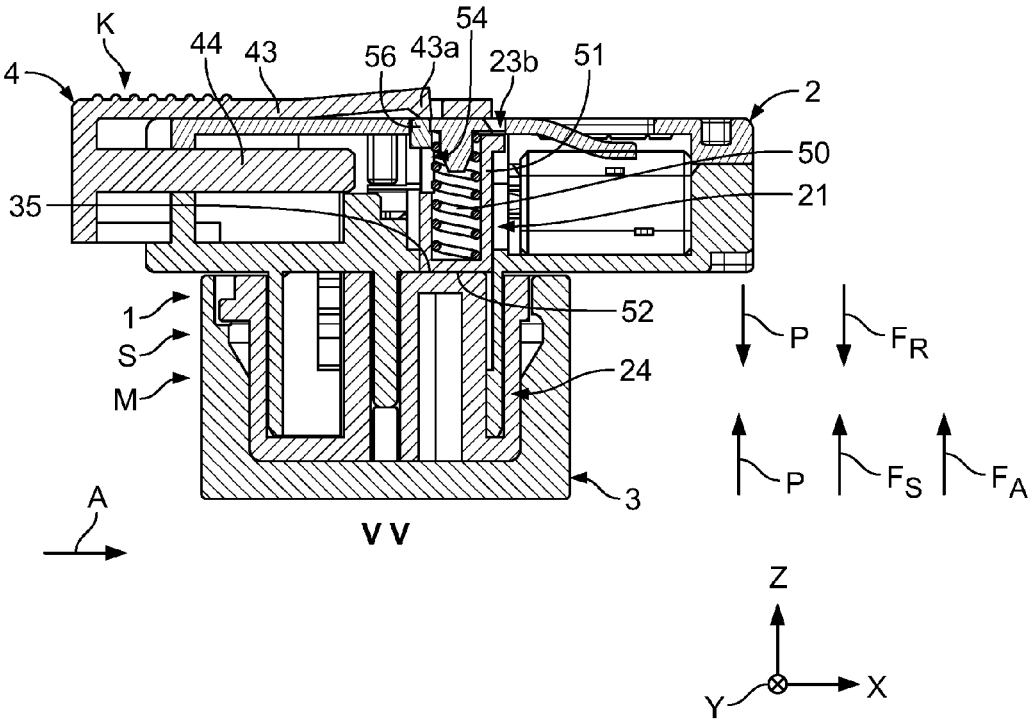
FIG. 8 is a cross-sectional view of the connector assembly according to the invention shown in FIG. 3 taken along line V-V.

FIG. 8 shows the plug-in connector assembly 1 in the assembled state S in a fully mated position M of the connector 2 and the mating connector 3 along the cross-sectional line V-V shown in FIG. 3. The plug section 24 is fully inserted into the cavity 34. The spring-apart face 52 abuts the front face 35 so that the spring force FS equaling the spring-apart force FA is exerted onto the connector 2 in a direction opposite to the plug direction P. The plunger 51 is urged, i.e. slid, into the interior 21 of the housing 20. The release element 56 on the plunger 51 extends into the first counter catch 23*a* so that the catch 53*a* of the blocking mechanism 43 is pushed out of the catch 43*a* in a direction opposite to the plug direction P and the lock 4 can be moved in the actuation direction A.

Figure 9:
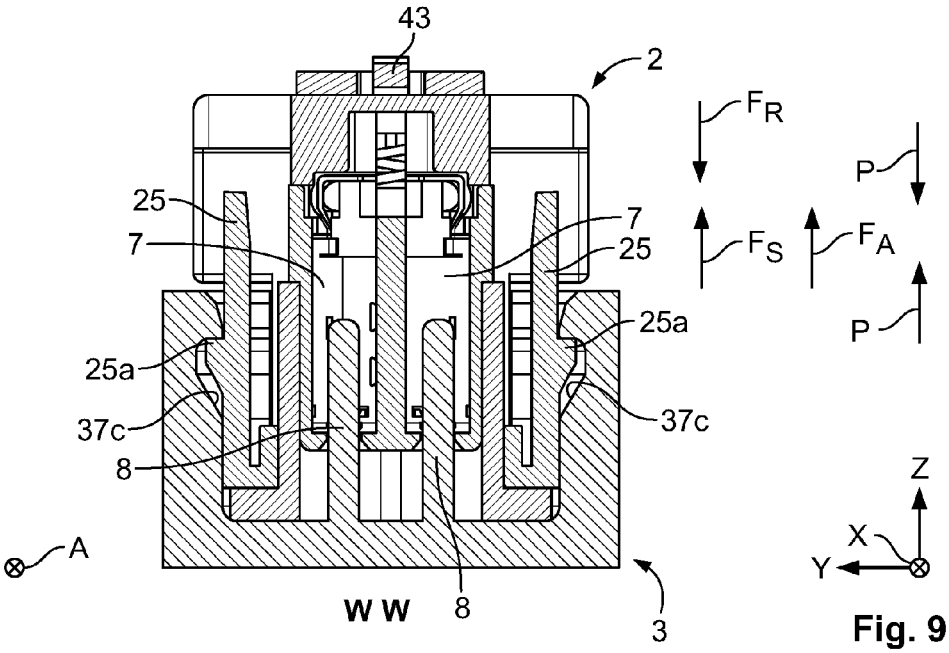
FIG. 9 is a cross-sectional view of the connector assembly according to the in invention shown in FIGS. 3 and 4 and taken along line W-W.

FIG. 9 shows the plug-in connector assembly 1 in the assembled state S and fully mated position M with the lock in the pre-locking position K but released and ready for actuation in the actuation direction A along the cross-sectional line W-W shown in FIGS. 3 and 5. The latches 25, in particular the detents 25*a* thereof, jut into the counter securing elements 38*c* so that the spring force FS corresponding to the spring-apart force FA is supported at the mating connector 3, in particular the counter securing element 38*c* formed at the casing 32. Hence, the mating connector 3 exerts a retention force FR in order to compensate the spring force FS and the spring-apart force FA. Further, in FIG. 9 it becomes apparent that the contact elements 7 take up the mating contact elements 8 so that an electrical connection is established.

Figure 10:
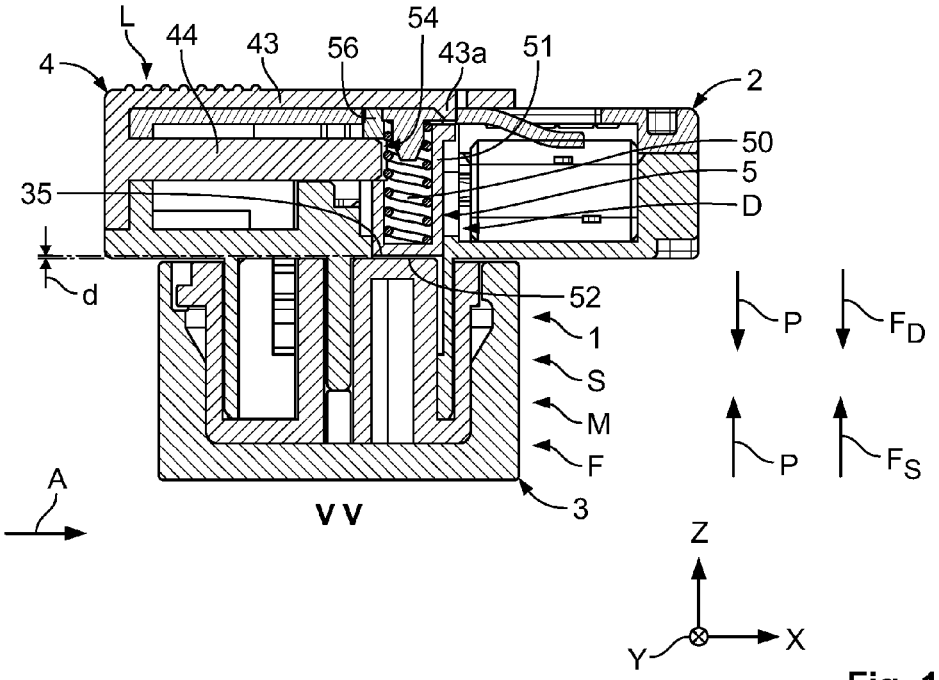
FIG. 10 is a cross-sectional view of the connector assembly according to the invention shown in FIG. 3 taken along line V-V.

FIG. 10 shows the plug-in connector assembly 1, in analogy to FIGS. 6 and 8, in a schematic cross-sectional view along the cross-sectional line V-V shown in FIG. 3 in the assembled state S as well as in the fully mated position M and further with the lock 4 in the locking position L. In the assembled state S, fully mated position M and locking position L, the plug-in connector assembly 1 is in a final state F, where it is ready for use. In the locking position L, the disabling mechanism 44 has been urged in the actuation direction A so that the catch 43*a* is slid beyond the first counter catch 23*a* in the actuation direction A. The catch 43*a* is in engagement with the second counter catch 23*b* and thereby fixes the lock 4 in the locking position L. In other words, the catch 43*a* extends into the second counter catch 23*b* and latches the lock 4 in the locking position L.

Further, the disabling mechanism 44 extends into the slot 54 so that the plunger 51 is supported below the release element 56. Thereby, the spring-apart face 52 is lifted away from the front face 35 and arranged at a distance d therefrom within the housing 20. Consequently, the disabling mechanism 44 absorbs the spring force FS. In other words, the disabling mechanism 44 and the spring arrangement 5 interact so that a disabling force FD is exerted, which compensates the spring force FS and thereby takes the load of the spring force FS off the mating connector 3. Thus, the spring arrangement 5 is in a disabled state D.

Figure 11:
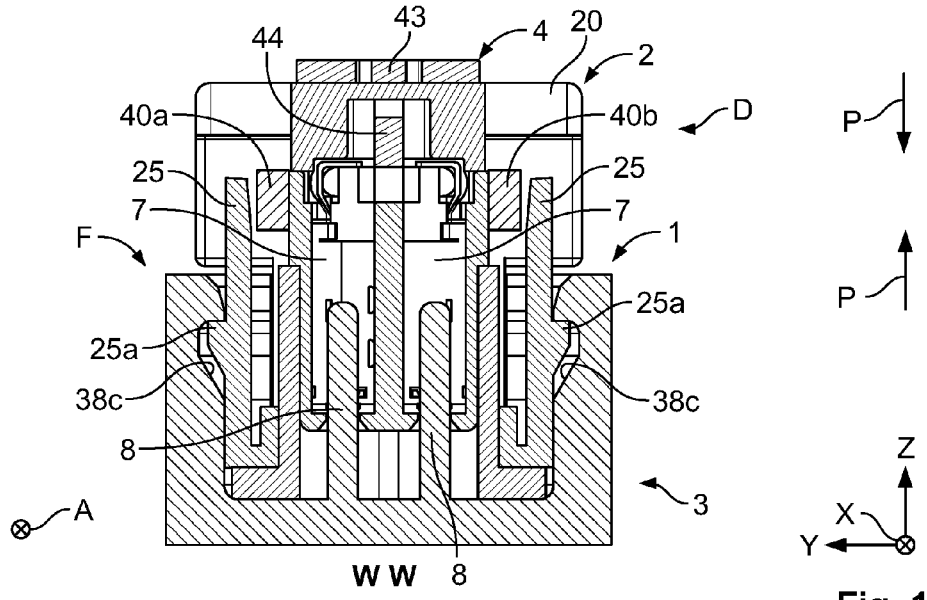
FIG. 11 is a cross-sectional view of the connector assembly according to the invention shown in FIGS. 3 and 4 taken along line W-W.

FIG. 11 shows a schematic cross-sectional view of the plug-in connector assembly 1 in the final state F along the cross-sectional line W-W depicted in FIGS. 3 and 5. Here it becomes apparent that the disabling mechanism 44 extends into the slot 54 while the blocking mechanism 43 is in engagement with the housing 20 of the connector 2, such that the spring arrangement is in the disabled state D. The connector 2 is latched to the mating connector by means of the latches 25 which engage the counter securing elements 38*c*. The mating contact elements 8 engages into the contact elements 7 that are securely held in place by the latching mechanism of the plug-in connector assembly 1. Further, the shafts 40*a*, 40*b* are arranged next to the latches 25 in order to prevent the latches 25 from being deflected and further to prevent the detents 25*a* from being withdrawn from the counter securing element 38*c*.

Deviations from the above-described embodiments of a plug-in connector assembly 1 according to an embodiment of the present invention are possible without departing from the scope of the invention and/or the inventive idea. The connector 2 can be provided with a housing 20 having an interior 21 which can be formed as required for accommodating the lock 4, the spring arrangement 5, electrical components 6, contact elements 7 and can have a plug section 24 formed as required for complementing a mating plug section 33 of the mating connector 3. The connector 2 and the mating connector 3 can be provided with contact elements 7 and 8, respectively, in whatever form and number required for establishing a desired electrical connection. Guides 22*a*, 22*b*, shafts 40*a*, 40*b*, openings 22, holders 23, counter catches 23*a*, 23*b*, pins 23*c*, latches 25, base sections 26, plug openings 27, wall sections 27*a*, guides 27*b*, terminal housing sections 28, plug sections 23 can be provided in any form and number desired for complementing the mating plug section 33, mating contact receptacles 33*a*, 33*b*, cavity 34, front faces 35, mating wall sections 36, fixation members 37, actuating sections 41, lateral faces 41*a*, cover sections 41*b*, lateral faces 41*a*, cover sections 41*b*, slits 42, blocking mechanisms 43, catches 43*a*, disabling mechanisms 44, springs 50, plungers 51, slots 54, releasing mechanisms 55, releasing elements 56 and limit stops 57.

The lock 4 and the spring arrangement 5 can have several functions. The first function of the lock can be to signalize a spring-apart position N in that a movement of the lock 4 is prevented so that the lock cannot assume the locking position L. A second function of the lock 4 can be to disable the spring arrangement 5. In turn, the spring arrangement 5 can be utilized for realizing the spring-apart function, and further can release the lock 4 from the pre-locking position K when the plug-in connector assembly 1 has reached the fully mated position M. In the fully mated position M, the latches 25 can act as primary lock latches 25, which can be held in place in the fully mated position M with the help of the shafts 40*a*, 40*b*, acting as locking mechanisms in that they prevent a deflection of the latches 25, in particular of the latching tongues 25*b* carrying the detents 25*a*, and thereby preventing unlocking of the primary lock as shown in FIG. 11.

What is claimed is:

1. A connector assembly comprising:

a connector having a housing with an upper shell and a lower shell, the lower shell having a lock receiving passageway extending into an interior thereof, a spring arrangement being inserted into a holder that is disposed on a first side of along the lower shell, and a plug section disposed on a second side of along the lower shell and opposite the spring arrangement holder;

a lock inserted into the lock receiving passageway for retaining the spring arrangement in the holder; and a spring arrangement inserted into the spring arrangement.

2. The connector assembly according to claim 1, wherein the housing has a locking guide extending along the lock receiving passageway.

3. The connector assembly according to claim 2, further comprising contact elements positioned in the lower shell.

4. The connector assembly according to claim 2, wherein the spring arrangement extends into the plug section.

5. The connector assembly according to claim 4, wherein the connector has a latch that protruding laterally from the housing.

6. The connector assembly according to claim 5, further comprising a mating connector received by the connector and having a casing and a retainer received within a pocket formed by the casing.

7. The connector assembly according to claim 6, wherein the mating connector has a mating plug section disposed at the retainer and a cavity for receiving the plug section of the connector.

8. The connector assembly according to claim 7, wherein the retainer has orientation elements matching a surface of the pocket.

9. The connector assembly according to claim 8, further comprising securing elements disposed on an outer circumference of the retainer and securing the retainer within the pocket.

10. The connector assembly according to claim 2, wherein the lock has a shaft supported by the locking guide of the connector.

11. The connector assembly according to claim 10, wherein the spring arrangement has a spring and a plunger with a spring holder receiving the spring.

12. The connector assembly according to claim 11, wherein the plunger has a slot extending through a wall thereof and into the spring holder.

13. The connector assembly according to claim 12, further comprising a releasing mechanism positioned above the slot and extending laterally away from the plunger.

14. The connector assembly according to claim 13, wherein the releasing mechanism has a release element that extends above an upper side of the plunger.

15. The connector assembly according to claim 14, wherein the plunger has a limit stop positioned on a side of the plunger opposite the slot and the releasing mechanism.

16. A connector comprising:

a housing having an upper shell and a lower shell forming a lock receiving passageway in the an interior of the housing;

a spring arrangement being inserted into a holder that is disposed in the interior of the housing and having a spring receiving passageway;

a plug section disposed along an outer surface of the housing and opposite the spring arrangement holder;

a lock having a first portion extending over the spring receiving passageway and a second portion received in the lock receiving passageway in the interior of the housing; and a spring arrangement in the spring receiving passageway of the holder and abutting of the lock.

17. A connector assembly comprising:

a first connector including:

(a) a housing having an upper shell and a lower shell forming a lock receiving passageway in the an interior of the housing, (b) a spring arrangement being inserted into a holder that is disposed in the interior of the housing and having a spring receiving passageway, (c) a plug section disposed along an outer surface of the housing and opposite the spring arrangement holder, (d) a lock having a first portion extending over the spring receiving passageway and a second portion received in the lock receiving passageway in the interior of the housing, and (e) a spring arrangement in the spring receiving passageway of the spring arrangement holder and abutting the lock; and a second connector mated with the first connector and having a plug section receiving the plug section of the first connector.

* * * * *